US005280148A

United States Patent [19]

Cummins

[11] Patent Number: 5,280,148

[45] Date of Patent: Jan. 18, 1994

[54] MECHANISM WITH DAMPER TO PREVENT OVERTRAVEL UPON SUDDEN RELEASE

[75] Inventor: Leonard D. Cummins, Cedarville, Ill.

[73] Assignee: Honeywell Inc., Minneapolis, Minn.

[21] Appl. No.: 972,653

[22] Filed: Nov. 6, 1992

[51] Int. Cl.[5] ..... H01H 3/42

[52] U.S. Cl. ..... 200/524; 200/314

[58] Field of Search ..... 200/524, 314

[56] References Cited

U.S. PATENT DOCUMENTS

| | | | |
|---|---|---|---|
| 3,523,168 | 8/1970 | Holmes | 200/314 |
| 3,766,346 | 10/1973 | Alexander | 200/524 |
| 4,254,315 | 3/1981 | Stevens | 200/524 |
| 4,585,914 | 4/1986 | Ohashi et al. | 200/524 X |

*Primary Examiner*—Renee S. Luebke

*Attorney, Agent, or Firm*—William D. Lanyi

[57] ABSTRACT

A damper is provided for a switch mechanism to prevent overtravel in response to a snap-release of a plunger when it is fully depressed. If no precautions are taken to prevent this type of overtravel, springs which urge the plunger away from its base can provide sufficient force to propel the plunger away from the base with sufficient speed and force to cause the plunger to travel past its intended unactuated position. The present invention utilizes a sloped cam surface which acts as a damper to divert the direction of travel of a cam follower relative to a cam and thereby dissipate the kinetic energy of the plunger, button and moveable components attached to the plunger.

8 Claims, 4 Drawing Sheets

MECHANISM WITH DAMPER TO PREVENT OVERTRAVEL UPON SUDDEN RELEASE

BACKGROUND OF THE INVENTION

1. Field of the Invention

The present invention relates generally to switch mechanisms and, more particularly, to switch mechanisms which incorporate a cam surface shaped to provide a damper so that overtravel of a switch plunger can be prevented when the plunger is suddenly released from a depressed position.

2. Description of the Prior Art

Many types of switch mechanisms are well known to those skilled in the art. A particular application of switch mechanisms of this type relate to pushbutton switches that comprise a plunger that is moveable relative to a base along an axis and which causes actuation of switching components when the plunger is depressed. Typically, the plunger is connected to a button that is depressible by a human finger. Some switch mechanisms cause actuation of a switch upon each depression of the button and plunger while other switch applications, referred to as alternate action devices, actuate on one push and release of the button and undo the actuation on a subsequent push and release of the button.

Regardless of the specific application of the switch mechanism, most known mechanisms utilize cams and cam followers to control the sequence of operations resulting from depression of the button and plunger. U.S. Pat. No. 4,254,315, which issued to Stevens on Mar. 3, 1981, discloses a pushbutton switch with a safety stop. The switch utilizes a locking mechanism that includes a cam member with a groove of the cam member being engaged by a cam follower. The groove is in the form of a closed loop path and the pushbutton is linked to the locking mechanism so that movement of the pushbutton moves the cam follower relative to the cam member along the groove. The cam follower moves only in an up and down direction in line with the axis of movement of the button and the cam moves in a direction perpendicular to that axis.

U.S. Pat. No. 3,523,168, which issued to Holmes on Aug. 4, 1970, describes a pushbutton switch which has a positive plunger safety stop carried in its casing. The switch has a tubular casing that receives a pushbutton at the upper casing end and has a lower switch at the lower casing end. The pushbutton is moveable inward into the upper casing end by an initial pushing inward followed by moving upwardly by a release counterspring action. The switch comprises a plunger guide that can have a plurality of grooves in which teeth of a plunger disc reciprocate vertically so that the plunger can not substantially rotate relative to the plunger guide. The guide has an upper circular edge above the grooves and the guide is enlarged radially outwardly to provide shoulders to hold the upper end and the lower bottom of the plunger guide between a lamp contact block and the bottom of a casing structure.

One serious problem that can occur during the operation of a pushbutton switch is the sudden release of the button while it is fully depressed relative to its housing. Since most pushbutton switches utilize one or more compression springs to urge the button and plunger outward relative to the case or housing, a sudden snap-release of the button can result in the rapid movement of the plunger and button away from the base of the switch to result in the button exceeding its normal unactuated position. In some extreme cases, the pushbutton and plunger can actually disconnect from the housing and be projected out of the pushbutton housing. In less extreme, but equally deleterious circumstances, the pushbutton can become separated from the plunger while remaining within the housing. The subsequent actuation of the device will require an initial force to reconnect the pushbutton and plunger followed by another force to actually actuate the device. Another possible result from a sudden snap-release is the movement of the plunger to a position normally assumed only during a relamping procedure as provided for in U.S. Pat. No. 4,254,315 described above and in U.S. patent application Ser. No. 973,132 which was filed by Cummins and Shaw on Nov. 6, 1993 and assigned to the assignee of the present application. The plunger could react to a snap-release by moving to the relamping position and require two sequential forces, separated by a release, to actuate the device. All of these possible results are seriously disadvantageous.

In view of the above problem, it would be significantly beneficial if a means were provided to prevent this type of overtravel in response to a snap-release of a button and plunger of a pushbutton switch.

SUMMARY OF THE INVENTION

The present invention provides a switch mechanism that comprises a means for preventing overtravel of the switch plunger in response to a snap-release when the plunger is depressed to its position most proximate the base of the switch. In a preferred embodiment of the present invention, the switch mechanism comprises a base, a cam follower which is attached to the base and a plunger that is moveable both toward and away from the base along a first axis. A cam is attached to the plunger and disposed in sliding contact with the cam follower. The present invention also provides a means for preventing overtravel of the plunger in a direction away from the base in response to a sudden release of the plunger from an actuated position.

In other words, a most preferred embodiment of the present invention comprises a means for preventing the plunger from moving away from the base by an excessive amount in response to the force provided by springs in a direction along the first axis when the button of the switch is snap-released while it is fully depressed and the springs are fully compressed. The preventing means in a preferred embodiment of the present invention comprises a cam surface that is formed in the cam directly below a position where the cam follower is disposed when the plunger is in its most proximate position relative to the base. The cam surface is sloped relative to the first axis by a predetermined angular offset.

In a switch made in accordance with the present invention, the switch mechanism further comprises a housing in which the base is disposed. In addition, a button is connected to the plunger and a switching component is disposed proximate the base for actuation by the plunger.

BRIEF DESCRIPTION OF THE DRAWINGS

The present invention will be more fully and clearly understood from a reading of the Description of the Preferred Embodiment in conjunction with the drawing, in which.

DESCRIPTION OF THE PREFERRED EMBODIMENT

Figure 1:
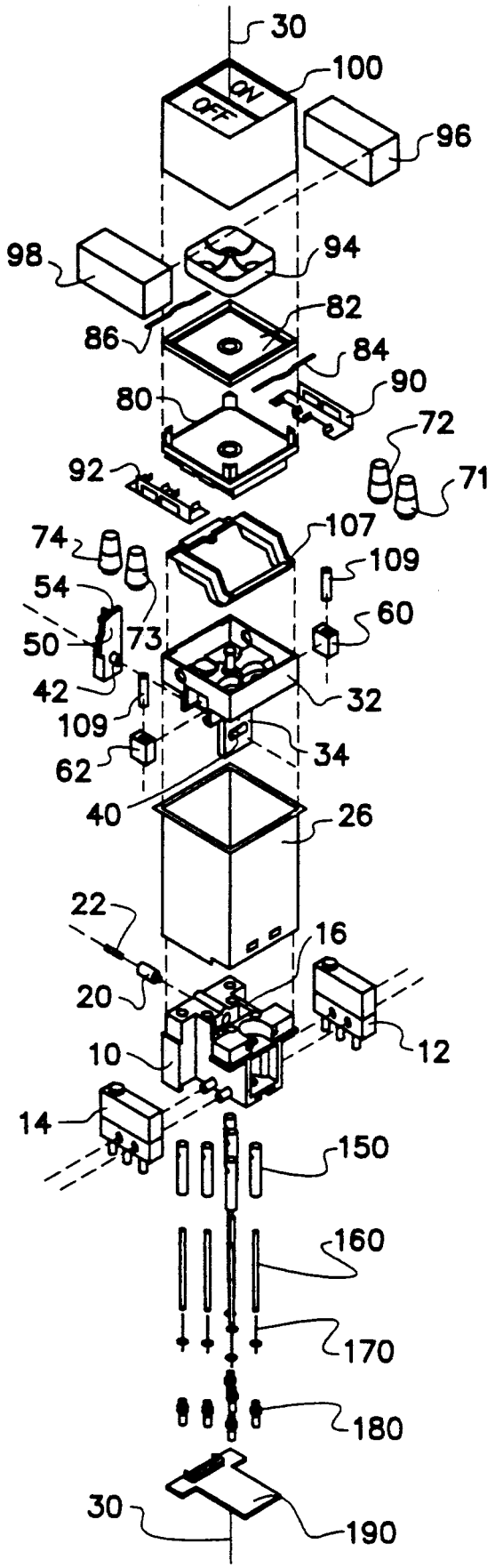
FIG. 1 shows an exploded view of a pushbutton switch in which the present invention can be employed.

Throughout the Description of the Preferred Embodiment, like components will be identified by like reference numerals.

FIG. 1 shows an exploded view of a pushbutton switch that is suitable for use in association with the present invention. In FIG. 1, a base is shown having an opening 16 formed therein. The base 10 is associated with two switching components, 12 and 14. The base 10 is connected to a cam follower 20 that is urged inward toward opening 16 by spring 22. The base 10 and its associated components are disposed within housing 26.

With continued reference to FIG. 1, a plunger 32 is provided with an attached extension 34 and is moveable in a direction along first axis 30. In FIG. 1, this movement is in an upward and downward direction relative to base 10. The extension 34 is provided with an opening 40 that is shaped to receive a protrusion 42 of cam 50. The plunger 32 is shaped to receive actuators, 60 and 62, so that the plunger 32 can carry the actuators and move them into contact with the switching components, 12 and 14, when the plunger 32 is moved into its downward position. The cam 50 has a protrusion 54 at its upper portion to limit the rotational movement of cam 50 with respect to the plunger 32.

Four lamps, 71, 72, 73 and 74 are shown in FIG. 1 along with a lamp holder 80. A seal 82 is associated with the lamp holder 80 and a suppressor 94 is disposed thereon. Also shown in FIG. 1 are springs, 84 and 86, and light pipes, 96 and 98. Stationary contacts, 90 and 92, are used in association with the lamp holder 80. A button 100 is shown at the top portion of FIG. 1. A travel stop 107 provides a tether that permits the lamp structures above the tether in FIG. 1 to be lifted upward relative to the plunger 32 without complete disconnection therebetween.

Compression springs 109 are used to urge the plunger 32 upward and away from base 10. In other words, when the button 100 is pushed downward the springs 19 are compressed and the switching components, 12 and 14 are actuated. When the downward pressure on button 100 is released, springs 109 urge the plunger 32 upward.

At the bottom portion of FIG. 1, tubular contacts 150 extend through holes in base 10. Compression springs 160 operate in association with contacts 150, adapter 170 and contacts 180 to maintain electrical contact between the lamps, 71, 72, 73 and 74, and contacts 180. A plate 190 is also provided. Compression springs 160 and springs 109 exert an upward force that pushes plunger 32 away from base 10 to return it to its neutral position when a downward force on button 100 is released.

The problems solved by the present invention can be described with respect to FIG. 1. If the button 100 is pushed downward to cause plunger 32 to move against the force of springs 109 and 160 to the fully depressed position of plunger 32, springs 109 and 160 will be at their maximum state of potential energy. If, when the plunger 32 is fully depressed as described above, the button 100 is suddenly snap-released, the full force of springs 109 and 160 could possibly propel the plunger 32 and button 100 in an upward direction along the first axis 30 away from base lo with sufficient speed to cause an overtravel condition to occur. This overtravel condition could result from relative movement between the cam follower 20 and the cam 50 beyond their normal operational positions. This overtravel, if it occurs, would be caused by the full release of the potential energy of springs 109 and 160 and the sudden conversion of that energy to kinetic energy in the plunger 32 and button 100.

Figure 2:
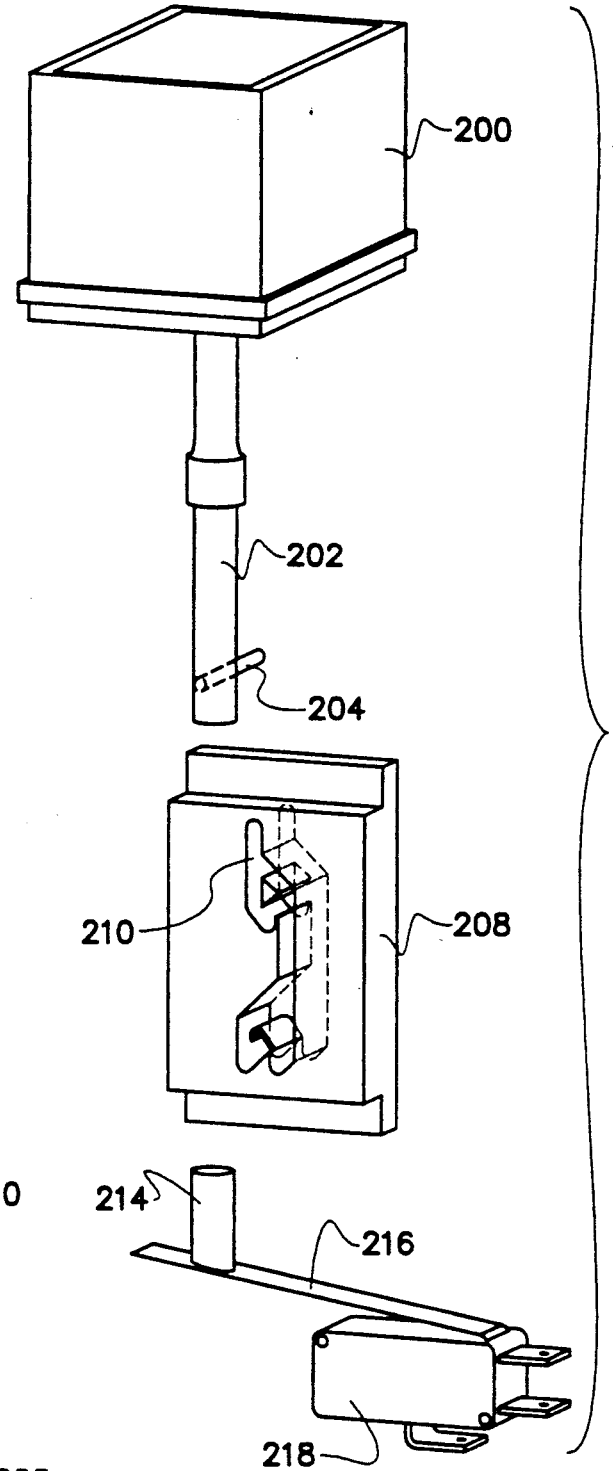
Fig.2 PRIOR ART
FIG. 2 shows a switch known in the prior art.

FIG. 2 shows a simplified illustration of a pushbutton switch that is known to those skilled in the art. The button 200 is connected to a shaft 202 that has a cam follower 204 attached to it. A cam structure 208 is provided with a closed-loop groove 210 in which the cam follower 204 is disposed. In FIG. 2, reference numeral 214 is used to identify an extension of shaft 202. As can be seen, shaft extension 214 is disposed in contact with an actuator arm 216 of a switching component 218. When button 200 is depressed, shaft 202 and 214 move downward under limitations provided by groove 210 on cam follower 204.

With continued reference to FIG. 2, it should be understood that cam 208 is limited to move left and right in FIG. 2 along rails or guides within the switch structure. This movement of the cam 208 is more fully described in U.S. Pat. No. 4,254,315 which has been discussed above.

Figure 3:
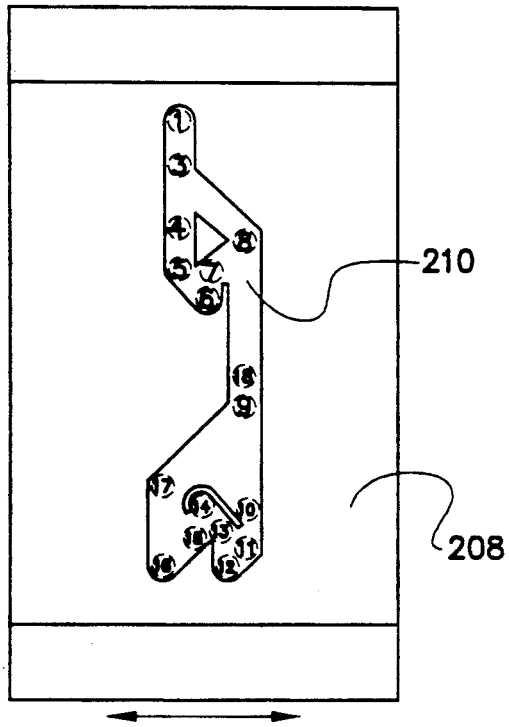
Fig.3 PRIOR ART
FIG. 3 shows a cam of the switch illustrated in FIG. 2.

FIG. 3 shows the cam 208 of U.S. Pat. No. 4,254,315 that is also shown in FIG. 2. The cam 208 is provided with a groove 210 in which the cam follower 204 is disposed. The sequential positions of the cam follower 204 within groove 210 are illustrated by the numbered circles within the groove.

With reference to FIGS. 2 and 3, it can be seen that the cam follower 204 is moveable with the button 200 and not attached to a base of the switch. In addition, the cam 208 is limited in its movement to an axis that is perpendicular to the direction of movement of the button 200 and shaft 202. The cam 208 is not attached to a plunger or to the button 200.

Figure 4A:
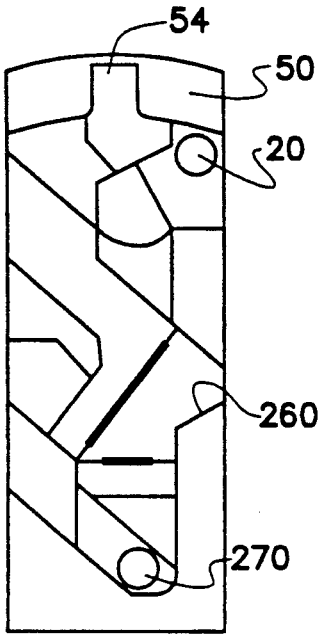
FIGS. 4A, 4B and 4C show sequential relative positions between a cam and a cam follower in response to the release of a plunger when the plunger is fully depressed relative to a base.
Figure 4B:
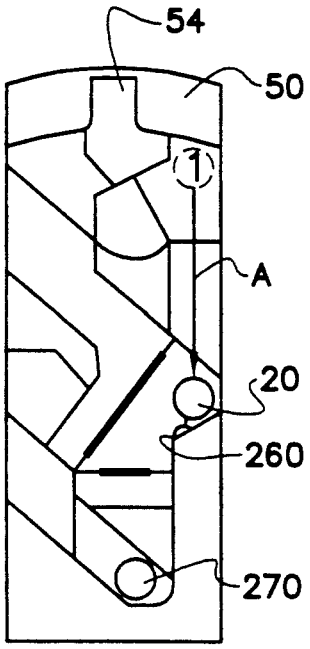
Figure 4C:
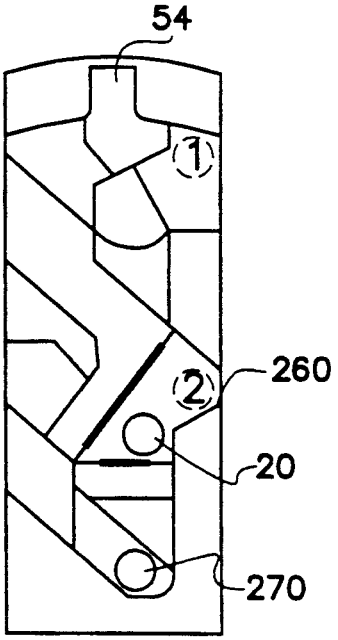

FIGS. 4A, 4B and 4C show sequential positions of the cam follower 20 of the present invention relative to the cam 50. FIG. 4A illustrates the position of cam follower 20 relative to cam 50 when the plunger 32 is fully depressed downward toward the base 10 in FIG. 1. Since the cam follower 20 is attached to base 10, and the cam 50 moves downward into opening 16 in coordination with the downward movement of extension 34 of plunger 32, the relative position of the cam follower 20 moves to its uppermost location on cam 50. The position of cam follower 20 in FIG. 4A will be referred to below as position 1.

FIG. 4B shows the cam follower 20 at a second position on the cam 50 in response to a release of button 100 and the rise of plunger 32 in response thereto. Since the cam 50 rises in result of the urging by springs 109 and 160 when button 100 is released, the relative position of can follower 20 moves downward relative to the cam 50. This relative downward movement is illustrated by arrow A. If the button 100 is snap-released when the plunger 32 is fully depressed in the direction toward base 10, the stored energy in springs 109 and 160 could possibly be sufficient to propel the plunger 32 and all of its attached components upward away from base 10 with sufficient speed to cause the moving parts to travel past their intended unactuated position away from base 10. However, with reference to FIG. 4B, it can be seen that a cam surface 260 is provided directly below the position of cam follower 20 when the cam 50 and plunger 32 are fully depressed. As a result of the location of surface 260, the upward movement of cam 50 causes cam surface 260 to strike the cam follower 20 and deflect the cam follower 20 toward the left relative to the location of cam 50.

As described above, the cam follower 20 is attached to base 10 and its movement is therefore restricted. The cam 50, on the other hand, is moveable along axis 30 in response to movement of the extension 34 of plunger 32. Therefore, in the discussion of the present invention in conjunction with FIGS. 4A, 4B and 4C, it should be remembered that cam follower 20 is the stationary component attached to base 10 and that cam 50 is the moveable component attached to extension 34 of plunger 32. In addition, it should be noted that the relative movement of protrusion 42 within opening 40 permits the cam 50 to move in a direction perpendicular to axis 30 and also permits cam 50 to rotate relative to extension 34 and plunger 32 within the limits provided by protrusion 54. Therefore, when cam follower 20 strikes surface 260, as shown in FIG. 4B, the cam 50 will be cause to move toward the right in FIG. 4B in reaction to this contact. However, the kinetic energy possessed by the plunger 32 and all of the moveable components attached to it will be dissipated and diverted by the sloping surface of cam surface 260.

FIG. 4C shows the position of the cam follower 20 after it has been deflected by surface 260 when cam follower 20 was at the position identified by the dashed circle and numeral 2. The position of cam follower 20 in FIG. 4C will be referred to below as position 3. The position of cam follower 20 in FIG. 4C is the rest, or neutral, position from which normal actuation can occur as a result of a subsequent depression of button 100 and plunger 32. In FIGS. 4A, 4B and 4C, a cam surface 270 is also identified toward the bottom portion of cam 50. Although not directly related to the operation of the present invention, the circular depression 270 in cam 54 is intended for use when the plunger 32 and button 100 are pulled upward and away from base 10 by an operator during a relamping procedure by which lamps 71, 72, 73 and 74 are changed. The operation of surface 270 and other cam surfaces. Not discussed above are described in detail in U.S. patent application Ser. No. 973,132 filed by Cummins and Shaw on the same date as the present application and which is assigned to the Assignee of the present application. Although that invention and the present invention share some similarities in shape, the relevant structure of the present invention and the function and objective thereof are distinct from that described in the Cummins and Shaw application.

Figure 5:
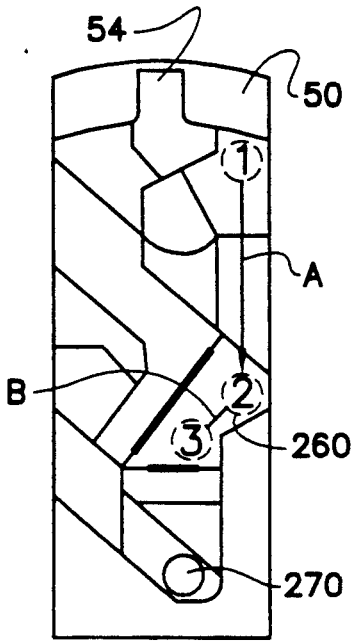
FIG. 5 represents a summary illustration showing the positions illustrated in FIGS. 4A, 4B and 4C.

FIG. 5 illustrates cam 50 with the three relevant positions identified thereon. The path taken by cam follower 20 from position 1 to position 2 is identified, as above, by arrow A and the short path taken by cam follower 20 between location 2 and location 3 is identified by arrow B. As described above, the movement of cam follower 20 between location 2 and location 3 is caused by its deflection against cam surface 260. It is this deflection that diverts the force caused by the conversion of potential energy of springs 109 and 160 to the kinetic energy of the plunger 32 and attached moveable components. The deflection of movement by cam surface 260 prevents the kinetic energy from causing the plunger and related components to overtravel its intended unactuated position.

Figure 6B:
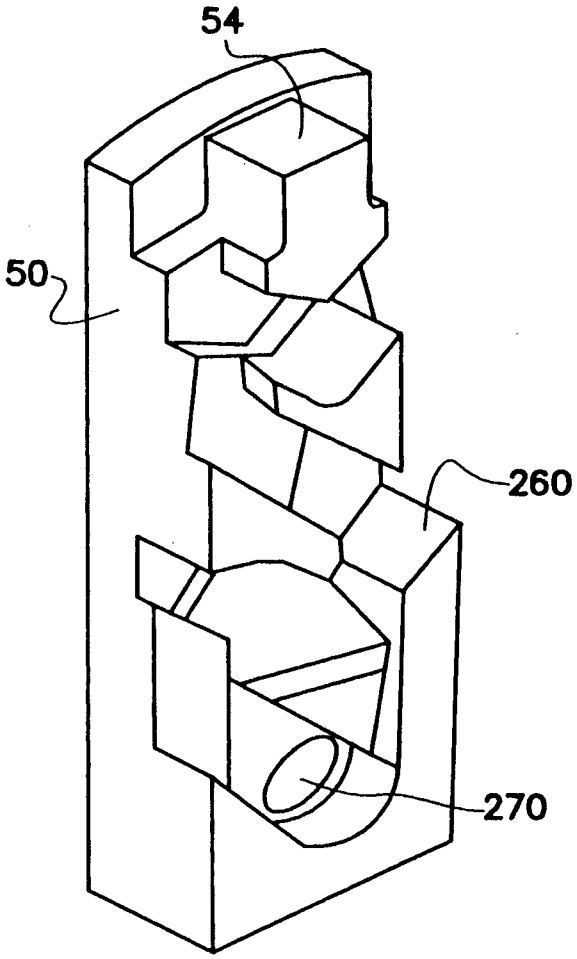
FIGS. 6A and 6B show two perspective views of the cam of the present invention.
Figure 6A:
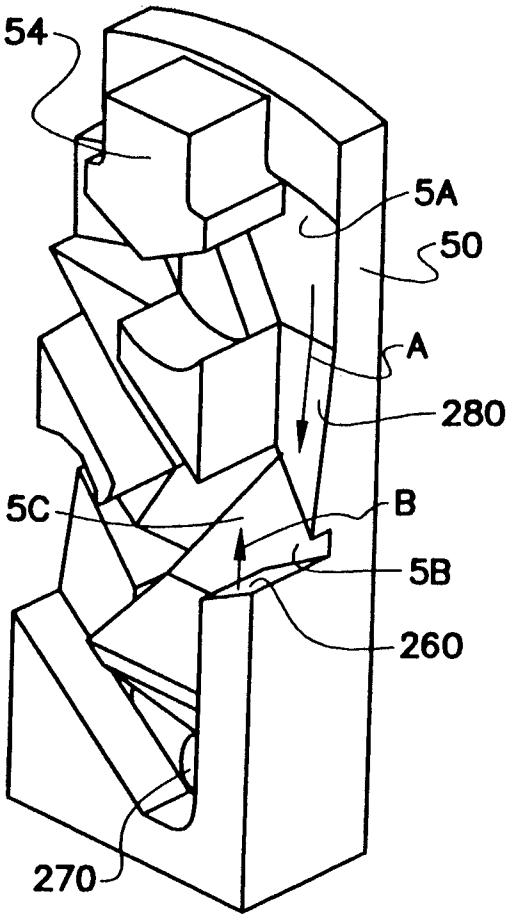

FIGS. 6A and 6B illustrate two perspective views of the cam surfaces of cam 50. In FIGS. 6A and 6B, the surface on which the cam follower 20 rests when at position 1 is identified as SA, the surface on which the cam follower rests when at position 2 is identified as SB and the position on which the cam follower 20 rests when in location 3 is identified as SC. These surfaces are not clearly visible in FIG. 6B because of the obstruction by other protruding surfaces of the cam face. When the cam follower moves, along the path identified by arrow A, from surface SA to the deflecting surface 260, it is diverted toward the center portion of cam 50 by the slope of surface 280. Eventually, cam follower 20 strikes surface 260 and is deflected toward surface SC in the direction represented by arrow B. It should be understood that when cam follower 20 strikes surface 260 it is proximate the surface identified as SB in FIG. 6A.

In FIGS. 6A and 6B, the protrusion 54 is shown at the top portion of cam 50. Although not directly relevant to the present invention and not shown in FIG. 1, plunger 32 comprises two travel limit stops which are disposed on opposite sides of protrusion 54 when cam 50 is attached to extension 34 of plunger 32. These travel stops operate in association with protrusion 54 to limit the rotation of cam 50 relative to plunger 32.

Although the present invention has been described with significant specificity and illustrated in detail to shown one particularly preferred embodiment of the present invention, it should be understood that alternative embodiments are within its scope.

The embodiments of the invention in which an exclusive property or right is claimed are defined as follows:

1. A switch mechanism, comprising:
a base;
a cam follower attached to said base;
a plunger moveable toward and away from said base along a first axis;
a cam attached to said plunger and disposed in sliding contact with said cam follower, said cam being movable relative to said plunger; and
means for preventing overtravel of said plunger in a direction away from said base in response to a sudden release of said plunger from an actuated position, said preventing means comprising a cam surface formed in said cam proximate a position where said cam follower is disposed when said plunger is in its most proximate position relative to said base, said cam surface being disposed at a preselected angle to the axis of travel of said plunger, said preselected angle being selected to absorb kinetic energy from said plunger when said plunger is released from said actuated position.

2. The switch of claim 1, further comprising:
a housing, said base being disposed in said housing;
a button connected to said plunger; and
a switching component disposed proximate said base for actuation by said plunger.

3. A switch mechanism, comprising:

a base;

a plunger, said plunger being movable relative to said base along a first axis;

a cam attached to said plunger for movement along said first axis, said cam being moveable relative to said plunger;

a cam follower attached to said base and disposed in sliding contact with said cam; and means for absorbing kinetic energy from said plunger when said plunger is snap released from a depressed position wherein said plunger is in a position most proximate said base, said absorbing means comprising a surface of said cam disposed at a preselected angle to said first axis and disposed proximate the location of said cam follower when said plunger is in said position most proximate said base.

4. The mechanism of claim 3 wherein:

said cam is attached to an extension of said plunger.

5. The mechanism of claim 3, further comprising:

a housing, said base and said plunger being disposed in said housing;

a switching component disposed proximate said base for actuation by said plunger; and a button attached to said plunger.

6. A switch mechanism, comprising:

a housing;

a base disposed in said housing;

a plunger moveable relative to said base along a first axis;

a cam attached to said plunger for movement with said plunger along said axis, said cam being movable relative to said plunger;

a cam follower attached to said base and disposed in sliding contact with said cam;

means for urging said plunger away from said base in a direction parallel to said first axis; and means for preventing overtravel of said plunger in a direction along said first axis away from said base when said plunger is snap-released when in a position most proximate said base, said preventing means comprising a means of absorbing kinetic energy created by expansion of said plurality of springs, said absorbing means comprising a slanted cam surface disposed at a preselected angle to said first axis for deflecting said cam follower in a lateral direction relative to said first axis, said cam surface being disposed proximate said cam follower when said plunger is in said position most proximate said base.

7. The mechanism of claim 6, wherein:

said urging means comprises a plurality of springs.

8. The mechanism of claim 6, further comprising:

a button attached to said plunger; and a switching component disposed proximate said base for actuation by said plunger.

* * * * *